US005727722A

United States Patent [19]

Rolt

[11] Patent Number: 5,727,722

[45] Date of Patent: Mar. 17, 1998

[54] CONVEYOR SYSTEM

[75] Inventor: Richard C. Rolt, Woolhope, United Kingdom

[73] Assignee: Rolt Designs Limited, Worcester, United Kingdom

[21] Appl. No.: 653,421

[22] Filed: May 24, 1996

[30] Foreign Application Priority Data

May 25, 1996 [GB] United Kingdom ..... 9510607

[51] Int. Cl.[6] ..... B23Q 15/00; B65H 20/00

[52] U.S. Cl. ..... 226/19; 226/95; 226/170

[58] Field of Search ..... 226/18, 19, 20, 226/95, 170

[56] References Cited

U.S. PATENT DOCUMENTS

| | | | |
|---|---|---|---|
| 3,321,121 | 5/1967 | Nyberg et al. | 226/95 |
| 3,679,112 | 7/1972 | Black et al. | 226/95 X |
| 3,784,071 | 1/1974 | Milan | 226/170 X |
| 4,437,918 | 3/1984 | Morohashi et al. | 226/19 X |
| 5,087,313 | 2/1992 | Duecker | 226/95 X |
| 5,362,041 | 11/1994 | Ryuzaki et al. | 226/19 X |

*Primary Examiner*—Michael Mansen
*Attorney, Agent, or Firm*—Rankin, Hill, Porter & Clark

[57] ABSTRACT

A conveyor belt system comprises a main conveyor belt mounted about rollers and moveable to carry a web from an infeed area. The belt is porous and air is drawn from a vacuum box underlying the belt to create a pressure differential across the belt to hold the web in position.

The position of the web in the infeed area is detected by a detector which is used to control the cross-belt which lies between the web and the conveyor belt. By transfers movement of the belt the position of the web can be maintained at a desired location relative to the belt. The use of a web as a position control member is more effective than the use of edge guides, particularly for thin or soft web materials.

7 Claims, 1 Drawing Sheet

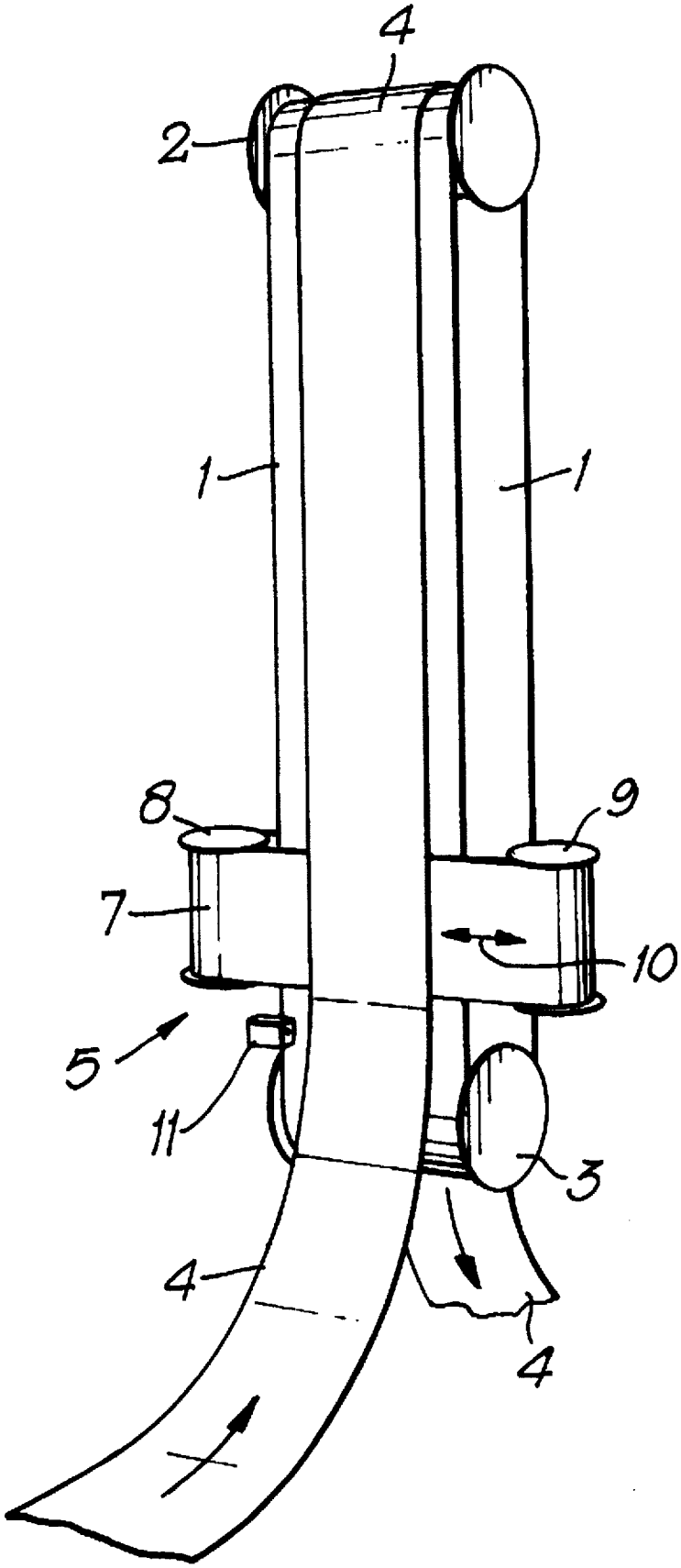
4
2
1
1
8
9
7
10
5
11
3
4
4

CONVEYOR SYSTEM

BACKGROUND OF THE INVENTION

This invention relates to a conveyor system, and more particularly to a conveyor system in which an air pressure differential across a porous conveyor is used to maintain a web of material in the correct position on the conveyor.

In certain applications, for example in certain belt conveyor dryers, a web of material is moved through a zone of a machine along the surface of a conveyor belt. In order to maintain the web in the correct design position the belt is porous and a pressure differential is maintained across the surface of the belt in order to hold the web firmly into engagement with the belt. Typically, the pressure differential is created by moving the belt over a vacuum box thereby drawing air through the belt and holding the web of material in the correct position.

With such arrangements the web shows considerable resistance to lateral movement on the belt. Whilst this is highly desirable once the web has been correctly positioned on the belt the resistance to lateral movement does mean that a significant lateral force must be applied to the web at the in-feed position in order to adjust the lateral position of the web on the conveyor. Conventionally, edge guides are provided at the infeed station in order to maintain the web at the correct position relative to the conveyor belt. However, because of the significant force required to shift the web laterally, if it tends to run-off from its desired position, existing systems of this type cannot cope with webs of thin and/or soft material since the edge guides under these circumstances will deform the edge of the material rather than move the material bodily if the material starts to run-off from its designated position.

SUMMARY OF THE INVENTION

In accordance with the present invention there is provided a conveyor belt system comprising a porous conveyor belt for receiving a web of material; means for maintaining a pressure differential across the surface of the conveyor belt to maintain the web of material in contact with the surface of the conveyor beat; and a position control member located in the zone where the web is fed onto the conveyor belt and positioned between the web and the conveyor belt to engage the face of the web which faces the conveyor belt and applied to that face lateral forces for adjusting the position of the web relative to the longitudinal direction of the conveyor belt.

By applying the lateral forces to the face of the web rather than to the edges of the web even relatively thin and soft webs may be positioned correctly on the conveyor belt.

In a particularly preferred embodiment of the invention the position control member comprises a belt the longitudinal direction of which is perpendicular to the longitudinal direction of the main conveyor belt. The main conveyor belt and position control belt can both be porous and subject to the pressure differential whereby the web material will be held in engagement with the position control belt sufficiently to ensure the required lateral forces can be applied to the web.

The main conveyor belt and the position control belt may be in light rubbing engagement.

The invention will be better understood from the following description of a preferred embodiment thereof, given by way of example only, reference being had to the accompanying drawing wherein the single figure shows schematically a conveyor system according to the present invention.

BRIEF DESCRIPTION OF THE DRAWINGS

The FIGURE is a perspective view of the conveyor belt system.

DESCRIPTION OF THE PREFERRED EMBODIMENT(S)

Referring to the drawing, the conveyor system comprises a main conveyor belt 1 mounted about rollers 2,3 and moveable to carry a web 4 which rests against the conveyor belt initially upwardly from an in-feed area 5 and then downwardly to an out-feed area located at the lower end of the opposite side of the conveyor belt. The conveyor system illustrated may, for example, form part of a dryer for drying the web 4 or drying matter contained on the web 4.

The conveyor belt 1 is porous and is mounted over a box connected to an extraction fan whereby air is drawn through the conveyor belt 1 both in the upwardly extending and the downwardly extending portions thereof. The pressure differential thus created holds the web 4 firmly in engagement with the conveyor belt.

The arrangement thus far described is conventional. In the conventional arrangement a pair of guide surfaces are provided in the in-feed zone 5 for centralising the web 4 on the conveyor belt 1. With such an arrangement, however, the apparatus is incapable of operating with very thin or soft webs since with such materials insufficient force can be applied to the side of the web by the guide plates to ensure that the web remains in the correct position.

In the case of the embodiment of the invention shown in the drawing a position control member 7 is located in the in-feed zone 5 between the web 4 and the surface of the conveyor belt 1. In the illustrated embodiment of the invention the position control member is in the form of a belt entrained about rollers 8,9 and moveable by suitable power means in each lateral direction indicated by the arrow 10. It should be understood, however, that other position control members could be used instead of the belt 7.

In use, the belt 7 rests lightly against the belt 1 and the web 4 rests against the outer surface of the belt 7. Preferably, the belt 7 is porous with the result that a small amount of air will be drawn through the surface of the belt 7 to maintain the web 4 in intimate contact with the surface of the belt. The pressure differential created should, however, be relatively small so that the web 4 can slide reasonably easy over the surface of the belt 7 as it is drawn away by the conveyor belt 1.

In use, with the conveyor belt 1 running the control of the conveyor belt 7 is operated to correct any tendency of the web 4 to run off the desired line of the conveyor belt 1. Such control is preferably effected automatically and to this end a sensor 11 is provided for detecting the position of the web as it approaches the conveyor system, and this information is fed via suitable control circuitry to the drive of the conveyor 7 so that the conveyor 7 will operate to maintain the web in the correct desired position.

I claim:

1. A conveyor belt system comprising a porous conveyor belt for receiving a web of material; means for maintaining a pressure differential across the surface of the conveyor belt to maintain the web of material in contact with the surface of the conveyor belt; and a position control member located in the zone where the web is fed onto the conveyor belt and positioned between the web and the conveyor belt to engage the face of the web which faces the conveyor belt and apply to that face lateral forces for adjusting the lateral position of the web relative to the longitudinal direction of the conveyor belt.

2. A conveyor belt system according to claim 1 wherein the position control means comprises a control belt the longitudinal direction of which is perpendicular to the longitudinal direction of the conveyor belt.

3. A conveyor belt system according to claim 2 wherein the longitudinal axis of the conveyor belt extends substantially vertically and the longitudinal axis of the position control belt extends substantially horizontally.

4. A conveyor belt system according to claim 1 wherein the conveyor belt and the position control member are both porous and are both subject to a pressure differential whereby the web material will be held in engagement with the position control member by the pressure differential thereacross.

5. A conveyor belt system according to claim 4 wherein the conveyor belt and the position control member are in light rubbing engagement and a common vacuum source is used to provide the pressure differential across both the conveyor belt and the position control member.

6. A conveyor belt system according to claim 1 wherein means are provided for detecting the position of the web and control means responsive to the detecting means are provided for automatically operating the position control member to maintain the web at a desired lateral location relative to the conveyor belt.

7. A conveyor belt system according to claim 1 in combination with drying means for drying the web or matter contained on the web whilst the web is in contact with the conveyor belt.

* * * * *